US009997039B1

(12) United States Patent
Heaton et al.

(10) Patent No.: US 9,997,039 B1
(45) Date of Patent: Jun. 12, 2018

(54) PERSONAL MONITORING AND NOTIFICATION SYSTEMS

(71) Applicants: Kurtis G. Heaton, Pleasanton, CA (US); Ryan K. Heaton, Pleasanton, CA (US)

(72) Inventors: Kurtis G. Heaton, Pleasanton, CA (US); Ryan K. Heaton, Pleasanton, CA (US)

(73) Assignees: Kurtis G. Heaton, Pleasanton, CA (US); Ryan K. Heaton, Pleasanton, CA (US)

( * ) Notice: Subject to any disclaimer, the term of this patent is extended or adjusted under 35 U.S.C. 154(b) by 0 days. days.

(21) Appl. No.: 14/215,053

(22) Filed: Mar. 16, 2014

Related U.S. Application Data

(60) Provisional application No. 61/791,729, filed on Mar. 15, 2013.

(51) Int. Cl.
*G08B 21/00* (2006.01)

(52) U.S. Cl.
CPC ..... *G08B 21/00* (2013.01)

(58) Field of Classification Search
CPC ..... A61B 5/00; G06F 19/3481; G06Q 30/02; G08B 21/00; G08B 21/24; G08B 21/245; G09B 7/02; G09B 19/00; A61J 2200/30; G16H 20/00; G16H 20/10; G16H 20/13
USPC .... 340/539.12, 540, 500, 572.1, 573.1, 603, 340/612, 613, 617, 669, 686.1, 689, 3.1, 340/4.1, 5.1, 6.1, 10.1; 600/300; 434/236
See application file for complete search history.

(56) References Cited

U.S. PATENT DOCUMENTS

| | | | | |
|---|---|---|---|---|
| 7,366,675 | B1 * | 4/2008 | Walker | G06F 19/3462 221/1 |
| 2006/0089542 | A1 * | 4/2006 | Sands | A61B 5/4833 600/300 |
| 2011/0169635 | A1 * | 7/2011 | Johnson | G08B 21/24 340/540 |
| 2011/0217681 | A1 * | 9/2011 | Krejcarek | G06F 19/3481 434/236 |
| 2012/0319856 | A1 * | 12/2012 | Johnson | G08B 21/24 340/669 |

* cited by examiner

*Primary Examiner* — Brian Wilson
(74) *Attorney, Agent, or Firm* — Wong & Rees LLP; Kirk D. Wong

(57) ABSTRACT

A web portal communicates with a variety of information sources that produce monitoring data. Information sources are configurable to user preferences and are trainable to detect patterns of sensory input. The information sources transmit the monitoring data to a central server that receives the data and traverses one or more logical rule sets to determine whether the inputted data violates policies and rules set by the user. The policies and rules define the level of monitoring desired and an appropriate response in the evaluation of the monitoring data against the rules. Based on an evaluation of the rules, the central server then generates outputs in the form of communication to the user via a variety of communication mediums and devices.

20 Claims, 7 Drawing Sheets

FIG. 2 (Top View)

FIG. 3 (Side View)

PERSONAL MONITORING AND NOTIFICATION SYSTEMS

TECHNICAL FIELD

The present disclosure generally relates to activity monitoring.

BACKGROUND

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

Tracking a person's intake of medication or performance of an exercise has been mostly limited to journal entries by the person, electronic reminders using electronic timers or applications on a computer. For medications, pill containers may have a digital clock attached to the container itself. The digital clock may be set to sound a reminder alarm whenever it is time for the user to take the medication. However, this approach relies on the user to pay attention to the alarm notification and to physically ingest or meter the medication to himself or herself, to remember to reset the alarm for the next dosage, etc. For example, a user may forget how many pills he or she had ingested from the pill container at the last alarm notification or even whether any pills were ingested from the pill container at the last alarm notification.

Relying on the user to manually or mentally record the occurrence and/or quantity of administered dosages of medication is fraught with errors that may be life-threatening.

BRIEF DESCRIPTION OF DRAWINGS

The present invention is illustrated by way of example, and not by way of limitation, in the figures of the accompanying drawings and in which like reference numerals refer to similar elements and in which.

DETAILED DESCRIPTION

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

Embodiments are described herein according to the following outline:

1.0. General Overview
2.0. Applications
3.0. Personal Medicine Compliance System
4.0. Additional Embodiments
5.0. Pill Bottle Cap Sensing & Notifying Device
6.0. Armband Sensing & Notifying Device
7.0 Personal Exercise Compliance System For Personal Fitness, Athletic Training, Physical Therapy, Or Weight Loss
8.0. Other Embodiments of Monitoring Systems
9.0. Implementation Mechanisms—Hardware Overview
10.0. Extensions and Alternatives

1.0 GENERAL OVERVIEW

Figure 1:
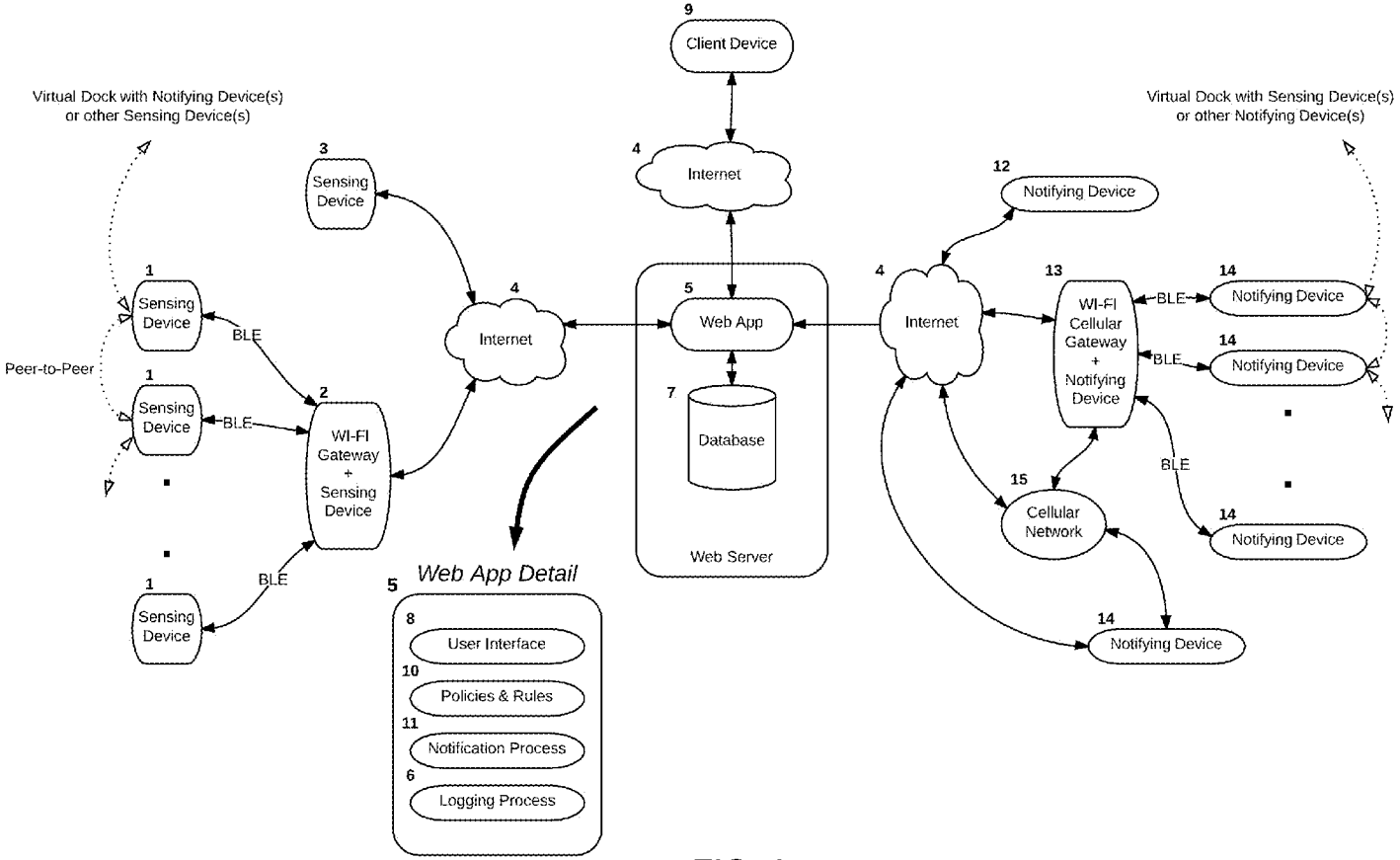
FIG. 1 illustrates a block diagram of system components, according to an embodiment of the invention.

Referring to FIG. 1 a block diagram of an embodiment of a user configurable compliance monitoring system producing personalized notifications is shown.

Bluetooth enabled, battery powered, wireless sensing devices 1 may be connected to the Internet via Bluetooth to Internet gateway adaptors 2. Wi-Fi enabled sensing devices 3 may be connected directly to the Internet 4 or any other communication network. Note that the terms "Bluetooth" and "Wi-Fi" used herein may be interchangeable and may be substituted with any wireless communication method or standard, including, but not limited to, any of: 802.11, Bluetooth, IR, any network in which at least one network connection is made without a physical wire or electrical contact, etc.

In an embodiment, sensing devices may be linked to a web hosted application 5.

In an embodiment, sensing devices may be placed on, in proximity of, or integrated into objects the user wishes to monitor. In an embodiment, each sensing device may have one or more sensors and may be configured to look for sequences of sensory input (e.g., sensory sequence patterns, etc.). When a sensing device detects a match of sensory input with one of its sensory sequence patterns, it sends a sensor event to the application event logging process 6. The event logging process stores the sensor event into the database 7.

A user interface 8 to the application 5 is presented via a client device 9, allowing users to personalize sensing devices by selecting default sensory sequence patterns initialized on the device during the manufacturing process, downloading patterns from the web application or teaching sensors new patterns by providing a range of stimulus to the sensors and saving the acquired data. In an embodiment, acquired data, also called memorized sensory sequence patterns, can be uploaded to the database 7, archived for use with other sensors, and/or shared with other users.

In an embodiment, using the application user interface 8, users can create policies and rules 10 to control how, where, and when, notifications will be sent to the user. Users author personalized notification messages or select from a range of default messages. Users can also access historical data and set up user preferences using the application interface.

In an embodiment, the main task of the application notification process 11 is to constantly monitor sensors events, comparing and analyzing them against rules and policies 10 created by a user, and generate notification events to alert, warn, or notify the user when necessary.

Notification events may be communicated to users, based on user preferences, via a variety of communication mediums and devices. Some notifications may be sent directly to Internet connected notifying devices 12. Other notifications may be routed through Internet to Bluetooth gateways 13 to Bluetooth enabled battery powered notifying devices 14. Some notifications may be routed through cellular networks 15.

In an embodiment, a notifying device automatically detects when other notifying devices or sensing devices are in physical proximity and notifies the web application, creating a virtual link between the devices. In an embodiment, a peer-to-peer network may be created between the devices. In an embodiment, another network may be used to create a communications link between the devices.

To facilitate and encourage the development of a variety of embodiments of sensing devices, notifying devices, gateways and web applications, devices and web applications communicate with each other using application programming interfaces (APIs). Application programming interfaces abstract out device and implementation specific characteristics and describe and prescribe the expected behavior. Application programming interfaces provide a means to share content and data and to access the resources in devices and web applications. All devices and web applications developed in accordance with the present disclosure can communicate and be compatible with each other, as long as they conform to the specifications and protocols of the application programming interfaces.

2.0 Applications

An embodiment generally pertains to systems and methods to provide for user configurable compliance monitoring with personalized notifications. An embodiment comprises a personal medicine compliance system.

Another embodiment may include, but is not limited to, any of: a personal fitness monitoring system, athletic training monitoring system, physical therapy monitoring system, weigh loss compliance monitoring system, etc.

Many other embodiments of the invention are possible. Examples may be embodiments that are comprised of any of: security monitoring systems, asset management monitoring systems, anti-theft monitoring systems, elderly care monitoring systems, baby/children/pet monitoring systems, etc.

3.0 PERSONAL MEDICINE COMPLIANCE SYSTEM

In an embodiment, a personal monitoring system may assist with compliance to taking medicines and supplements.

For individuals who take medications and supplements, it is critical that doses of medicine and supplements be taken consistently, without missing or taking extra doses. Achieving perfect compliance is extremely difficult as people are easily distracted and are often not as focused on routine tasks like taking medicines.

Another problem is a person can take medicine "out of habit" and not be aware afterwards the dose was taken. This can result in inadvertently taking an extra dose, or choosing to not take medicine because the person is not sure if they took a dose or not. It can be especially difficult to remember to take medicine when a person's daily routine varies from day to day.

An embodiment provides users with a system that can be personalized to their preferences and lifestyle, that helps remind them to take their medicines and supplements, and helps ensure they have access to the quantities needed at the time and location where each dose needs to be taken.

An embodiment assists a person to comply with taking doses of medicines and supplements on a consistent schedule. It addresses the common reasons for non-compliance: 1) forgetting to take a dose of medicine, 2) taking a dose too early, 3) not having a dose physically available to take, 4) providing a means to find out whether a dose was already taken, if one is not sure, and 5) inadvertently taking a second dose because one forgot a dose had already been taken.

The following example illustrates how an embodiment may be used to assist a person taking doses of medication and supplements on a regular schedule.

In an embodiment of a medicine compliance system, a sensing device 1 is implemented in a small form factor about the size of a thick quarter or less. A Bluetooth Low Energy (BLE) radio, microcontroller, motion sensors, touch proximity sensors, small coin cell battery, etc., may be integrated into the device. To allow the device to also function as a notifying device, a small display and LEDs may be added to the device.

A notifying device 14 may be implemented in the form of a fashionable rubberized arm or ankle band. A BLE radio, microcontroller, vibration unit, LEDs and small battery may be integrated into the band.

In an embodiment, a gateway device 2, 13 may be implemented with an application on a mobile device carried by the user.

In an embodiment, a user attaches one of the coin-size sensing devices to a bulk storage container of medicine (bulk sensor). A second coin size sensing device is placed on a small container used as portable medicine storage (portable sensor) and carried by the user. Each of these sensors may also function as notifying devices.

In an embodiment, a band shaped notifying device may be placed on the users arm or ankle.

In an embodiment, using a mobile device or laptop as a client device 9, the user accesses the sensing devices and places them into a learn mode. The user fills each of the containers with medicine. The sequence of sensory inputs to complete this action may be saved by each of the sensors into memory and can be used to detect when a container is refilled.

The user then opens each container and removes a dose of medicine. The sequence of sensory inputs to complete this action is saved by each sensor into memory and may be used to detect when the user takes a dose of medicine.

The user sets up policy and rules 10 by entering into the web application information that includes any combination of: information about medicine the user takes at various times of the day, the window of time each dose is to be taken in, the number of doses stored in each medicine container, information about the mobile device used as a gateway, cell phone numbers and email addresses to send alerts to, etc.

Assume for illustration purposes, the user sets up rules that three doses of medicine must be taken each day at 8:00 am, 1:00 pm, and 10:00 pm. The user also sets a rule that medicine must be taken no sooner than two hours before and no later than two hours after the scheduled event. Also assume the user enters into policies and rules 10 information that the bulk storage container holds 30 doses and the portable storage container holds three doses.

The notification process is then activated and monitoring begins. Using Bluetooth protocols, the sensing devices on the medicine containers discover they are in proximity to each other (virtual dock) and report this information to the application.

At 9:00 am the user removes a dose of medicine from the bulk storage container. The bulk sensor detects the action and reports the event to the application for logging 6.

The user leaves for work. The portable sensor detects it is no longer in proximity to the bulk sensor and reports this information to the application. The application confirms the portable container has three doses of medicine and only needs one for the day, so no alerts may be generated.

On the way to work, the user questions whether or not the morning dose was taken. He or she has the option of either checking history on the application or just attempt to take another dose. In this example, the user decides to attempt to take another dose. The portable sensor detects a dose of medicine being removed, reports the event to application via the gateway device. The notifying process detects that, based on the rules 10, it is too early to take another dose. To alert the user to not take the dose, the notifying process 11, based on user preferences, sends a text to the user's mobile phone, sends an alert to the portable medicine container sensor (which also contains a notifying device) and/or sends an alert to the armband notifying device. The LEDs on the portable sensor begin to flash and the armband vibrates. The user, recognizing the alert, places the medicine back into the container.

The user arrives at work and forgets to take the 1:00 pm dose. At 3:00 pm, the application notifying process detects that parameters for a rule have not been met. An event was not received from either the bulk or portable sensor that a dose was taken and the 1:00 pm dose is two hours late. The notifying process sends a text to user's cell phone, sends an email, sends an alert to the armband notifying device, etc. The user, recognizing the alert, takes a dose from the portable storage container and the portable sensor reports the event to the application.

The user arrives back home where the portable and bulk storage sensors discover they are in proximity and report this information to the application. The application checks the quantity of doses in the portable storage container. If the dose is below a threshold set by the user, it generates alerts to the user to refill the portable storage container.

At 11:00 pm the user takes the final dose for the day from the bulk container. The bulk sensor reports the event to application. The application checks the quantity of doses left in the bulk storage container and, if it is at a level below a threshold set by the user, it generates reminders to the user to refill the bulk medicine container.

The cycle repeats itself the next day, with the notification process monitoring sensor events and generating notification based on the policies and rules.

4.0 ADDITIONAL EMBODIMENTS

In embodiments of medicine compliance systems, additional sensing devices, gateways and notifying devices can be added to further personalize the system to users' preferences and lifestyles. These additional devices can improve the accuracy of the monitoring and enhance the probability that a user is notified in a timely manner.

For example, integrating the bulk and portable sensor devices into storage containers will further enhance medicine-monitoring systems. The sensor's ability to detect when a dose is taken is improved and the sensor can more accurately measure the quantity of medication remaining. Sensor devices may be manufactured at low costs enabling the sensor devices to be disposable.

Examples of various embodiments of sensing devices include any of: 1) sensors that attach to pill bottles, pill storage containers with dividers for individual doses, containers of any size or shape used to store medicine, etc., 2) sensors integrated into pill caps, pill bottles, pill storage containers, etc., or 3) sensor built into specialize hardware to be placed at various locations, e.g., in a home, car, office, etc. Many other sensing devices in accordance with some embodiments are possible.

Fashionable portable notifying devices can be created, designed to match user's lifestyles and preferences, increase the probability of use, thus improving compliance. In addition to wrist/ankle bands, other embodiments of notifying devices include any of: watches, key fobs, jewelry in various fashionable forms, etc.

Examples of various embodiments of notifying devices include, but are not limited to, any of: 1) devices that attached discreetly to one's wrist or ankle and provides discrete alerts by: vibration, electro-mechanical means, displays, lights, sound, etc., 2) health monitoring devices, watches, other wearable devices, etc., 3) mobile devices including, but not limited to, any of: cell phones, tablets, computers, etc., 4) electronic devices including, but not limited to, any of: computers, set-top boxes, etc., 5) specialized hardware mounted at various locations, e.g., in a home, car, office, etc., or 6) specialized hardware built into bottle caps, sensing devices, key fobs, etc. Many other notifying devices in accordance with some embodiments are possible.

Notification alerts can be communicated to a user via a variety of formats. Examples include, but are not limited to, any of: vibration, electro-mechanical means, displays, lights, sound, emails, texts, phone calls, etc.

An embodiment of a medicine compliance system can be further enhanced by adding stationary gateways. Stationary gateways, with integrated sensing and reporting devices, placed in visible locations enhance the probability that Bluetooth enabled devices are able to find a gateway to communicate to the server and that the user receives critical notifications. In an embodiment, a stationary gateway with sensing and notification abilities includes, but is not limited to, any of: a Bluetooth to Internet bridge, motion sensors, any device that can provide audio and visual alerts that are difficult to ignore, etc. The gateway may be placed in a highly visible location such a bedroom nightstand or near exit doors at the user's residence. A second stationary gateway may be placed at the user's place of employment and a third gateway with cellular access may be mounted in the user's automobile.

5.0 PILL BOTTLE CAP SENSING & NOTIFYING DEVICE

In an embodiment, a combination sensing and notifying device is integrated in a pill bottle cap.

Figure 2:
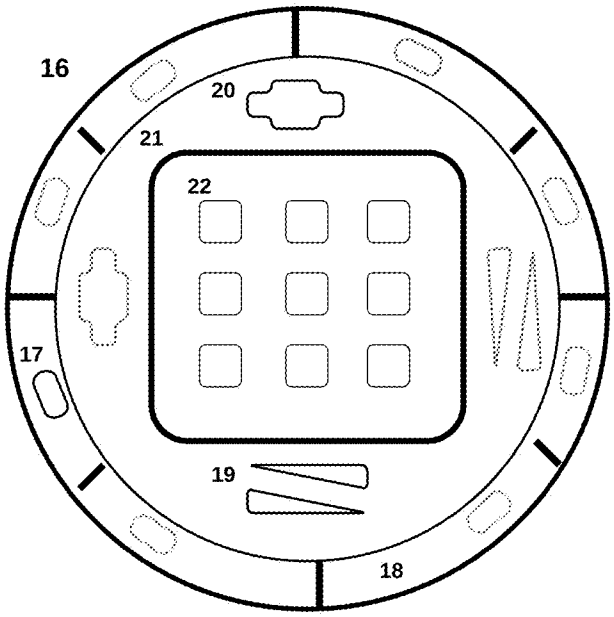
FIG. 2 illustrates a top view of the pill bottle cap, according to an embodiment of the invention.

FIG. 2 depicts a top view of the pill bottle (or medication container, any type of container, etc.) cap 16. The pill cap includes any combination of: a small display 21, touch and proximity sensors 19, 22, wireless antennas 20, a ring of LED's 17 and/or light pipes 18, various other components integrated in the cap, etc.

Figure 3:
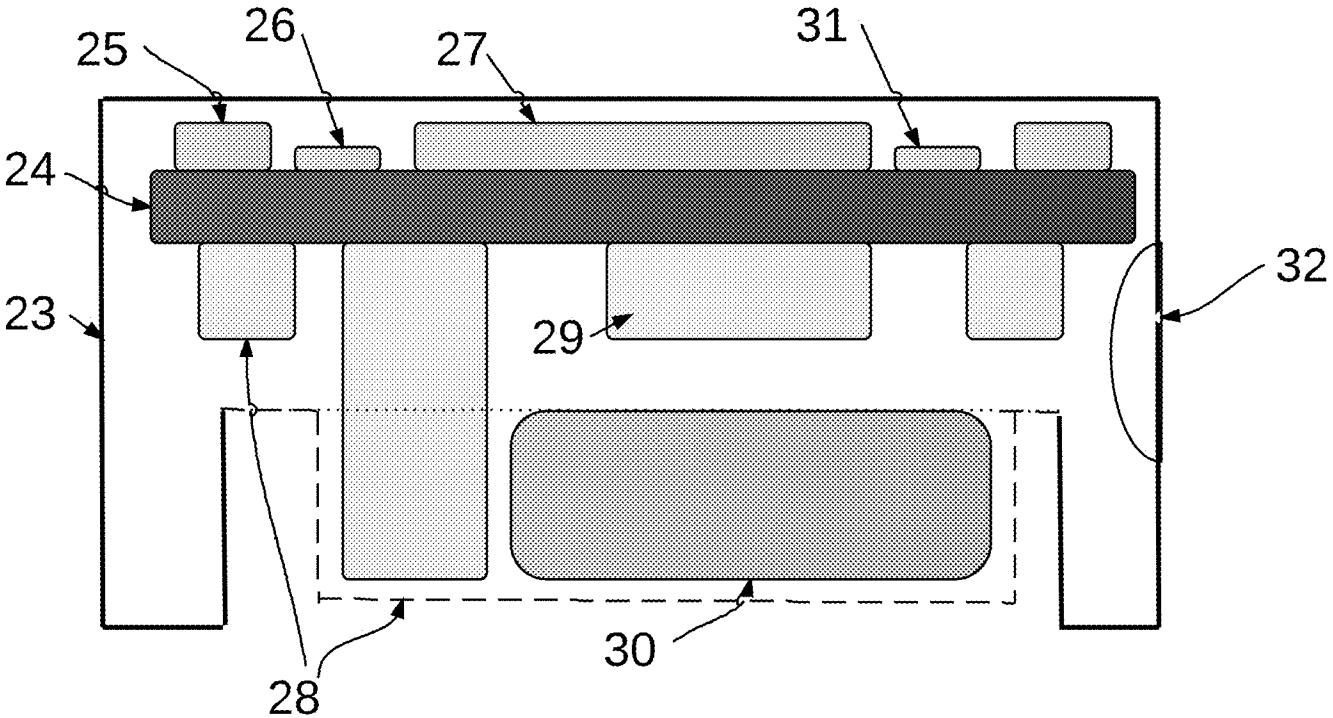
FIG. 3 illustrates a side view of the pill cap, according to an embodiment of the invention.

FIG. 3 depicts a side view of the pill cap 23 showing the display 27, LED'S 25, antennas 26 and touch and proximity sensors 31. Other components include any combination of: a printed circuit board 24 with a wireless controller unit 29, a motion tracking unit, light & optical sensors 28 mounted onto the board, etc. Also integrated into the cap may be an audio sounder/speaker 32, power and clock distribution, battery 30, etc.

Figure 4:
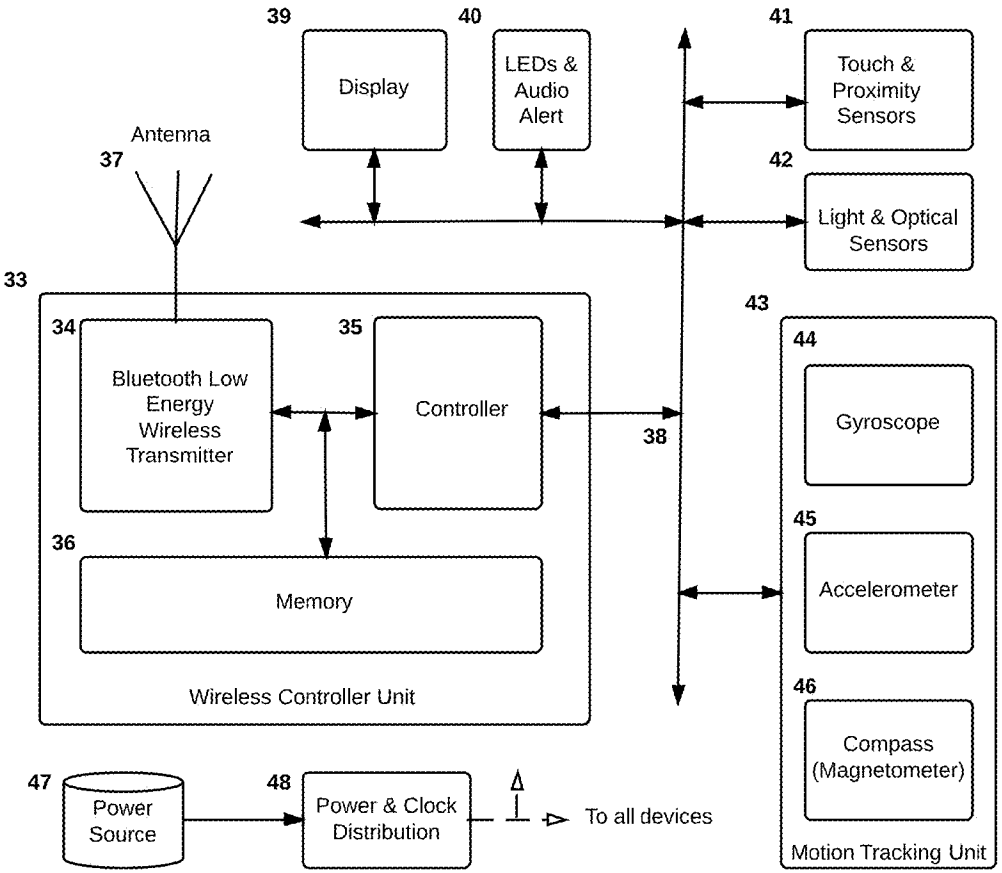
FIG. 4 illustrates a block diagram of a pill bottle cap system, according to an embodiment of the invention.

FIG. 4 depicts a block diagram of the device. A wireless controller unit 33 includes, but is not limited to, any of: a Bluetooth wireless radio 34, a controller (e.g., controller, processor, CPU, etc.) 35, memory 36, interfaces to antennas 37 and other components 38, etc. The controller interfaces to various information gathering and notification components including, but are not limited to, any of: a display 39, LEDs and audio sounder/speakers 40, touch & proximity sensors 41, light & optical sensors 42, a motion tracking unit 43, etc. The motion tracking unit may include, but is not limited to, any of: a gyroscope 44, accelerometer 45, a compass 46, GPS sensor, etc. A battery power source 47 powers a clock distribution circuit 48 that is routed to all other components.

Various software routines may be saved in memory 36 as part of the manufacturing process. These may include routines to initialize the controller 35 and wireless transmitter 34 and communicate with a web application 5 via a Bluetooth to Internet gateway 2. In an embodiment, the web application can update, remove, replace or add to the software routines in memory.

During the manufacturing process, various sets of sequences of sensory input (e.g., default sensory sequence patterns, etc.) to detect one or more events that may occur may be saved in memory. The user can choose to use these default patterns, or execute a software routine to download new patterns (downloaded sensory sequence patterns) from the web application and save them into memory to add to or replace the default sequences. The user can also execute learning mode software routines to allow users to create their own patterns (e.g., memorized sensory sequence patterns). While in learning mode, the user may be prompted to perform a sequence of actions typical of the event the user wishes the device to detect. For example, to store a pattern to detect that the user has taken medicine from the pill bottle, the user might remove a pill by picking up the pill bottle, grasping the cap, push and twist it, remove the cap, invert it, place it on a table, remove a pill, replace the cap and then set the bottle down. Sensor input from all of the sensors during these actions may be captured by the controller 35 and saved into memory 36. A user can have the system memorize several sensory sequence patterns for the same event, if they wish, to increase the probability that the event will be successfully detected.

In an embodiment, memorized patterns can be uploaded to the web application, archived in the database 7, and shared with other sensors. In an embodiment, a user can also use a software routine to capture raw sensor data and transmit this data to the web application.

After sensory patterns are in place, software routines to monitor sensor input may be executed by the controller 35. Sensor input is captured and analyzed. When sensory input matches one of the sensory sequence patterns saved in memory, monitoring software transmits a data packet over the wireless link 34 to the web application that a match (e.g., sensor event) has occurred. The sensor event data packet contains information about what event occurred.

In an embodiment, a software routine on the controller may also monitor light and optical sensors 42 to detect how many pills are remaining in the pill bottle and transmits this information to the web application. The web application can also query and request information about how many pills the sensors can detect.

Software routines executed by the controller also handle requests, transmitted via the wireless interface from the web application, to notify the user (e.g., notification events). Examples of notifications may include, but are not limited to, any combination of: to display a message on the display 39, sound an audible alarm 40, illuminate one or more LEDs 40, etc.

6.0 ARMBAND SENSING & NOTIFYING DEVICE

In an embodiment, a notifying device is integrated into a flexible armband.

Figure 5:
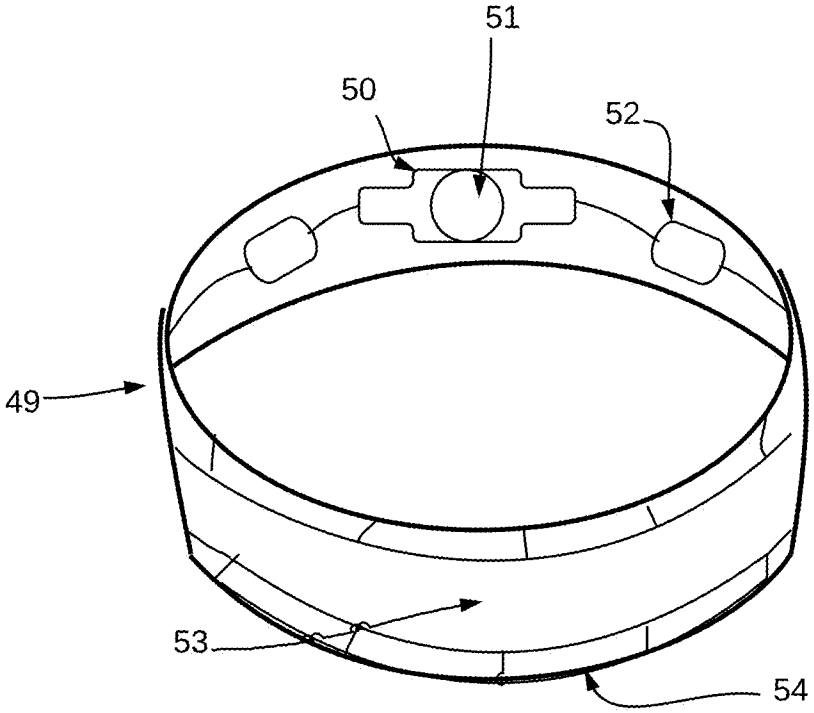
FIG. 5 illustrates a flexible armband that can be attached to a user's wrist or ankle, according to an embodiment of the invention.

FIG. 5 depicts a flexible armband 49 that is attached to a user's wrist or ankle. The armband includes, but is not limited to, any of: a flexible display 53, rings of touch and proximity sensors and LED's 54, a wireless controller, antennas, motion tracking unit and various other components 50, power source 51, vibration/audio/electro-mechanical alert devices 52 integrated in the armband, etc.

Figure 6:
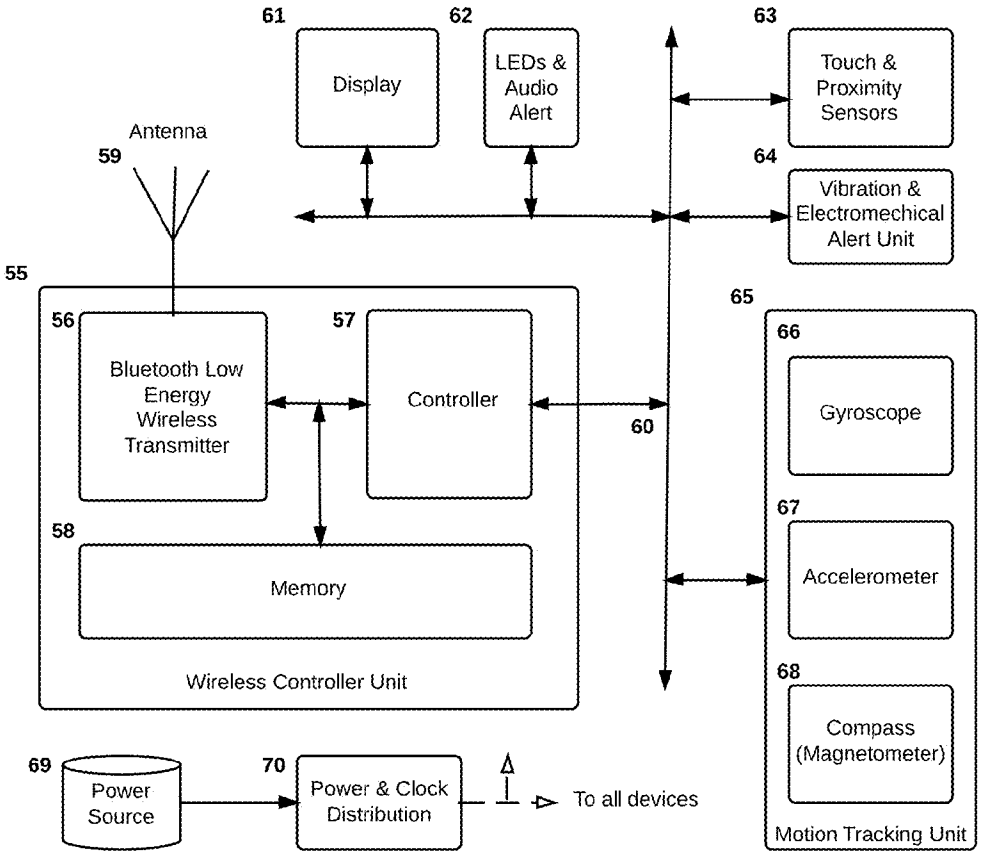
FIG. 6 illustrates a block diagram of an armband system, according to an embodiment of the invention.

FIG. 6 depicts a block diagram of the device. A wireless controller unit 55 includes, but is not limited to, any of: a Bluetooth wireless radio 56, a controller 57, memory 58 and interfaces to antennas 59, other components 60, etc. The controller interfaces to various information gathering and notification components including, but not limited to, any of: a display 61, LEDs and audio sounder/speakers 62, touch & proximity sensors 63, vibration/electro-mechanical alert unit 64, a motion tracking unit 65, etc. The motion tracking unit includes, but is not limited to, any of: a gyroscope 66, accelerometer 67, a compass 68, a GPS sensor, etc. A battery power source 69 powers a clock distribution circuit 70 that is routed to all components.

Various software routines may be saved in memory 58 as part of the manufacturing process. These may include routines to initialize the controller 57 and wireless transmitter 56 and communication with a web application 5 via a Bluetooth to Internet gateway 2. The web application can update, remove, replace or add to the software routines in memory.

Similar to the Pill Bottle Cap Sensing & Notifying Device described herein, default sensory sequence patterns may be saved in memory as part of the manufacturing process. The user can download new patterns and have the system memorize their own sensory sequence patterns.

After sensory patterns are in place, software routines to monitor sensor input may be executed by the controller 57. Sensor input is captured, analyzed and an event data packet transmitted over the wireless link 56 to the web application when a match occurs.

Software routines executed by the controller also handle requests, transmitted via the wireless interface from the web application, to notify the user (notification events). Examples might be to display a message on combination of: the display 61, sound an audible alarm 62, alert the user with vibration/electro-mechanical event 64, illuminate one or more LEDs 62, etc.

7.0 PERSONAL EXERCISE COMPLIANCE SYSTEM FOR PERSONAL FITNESS, ATHLETIC TRAINING, PHYSICAL THERAPY, OR WEIGHT LOSS

An embodiment comprises a personalized exercise monitoring system for compliance to personal fitness, athletic training, physical therapy, weight loss programs, etc.

In some applications, it is critical to know if a sequence of events occurred in a particular way. For example, physical therapy often requires a patient to move an object through a sequence of motions, at a prescribed pace, for some duration of time. The patient might be required to grasp a hand weight and move it through a range of motion for some number of repetitions. This sequence of motions might need to be repeated every other day for a number of weeks. To receive the maximum benefit, just completing the exercise in not sufficient. The patient must not only complete the exercise, but the hand weight must be positioned and taken through a range of motion as prescribe by a physical therapist. If the correct motion is not followed, not only is the maximum benefit not achieved, the patient may cause further damage to his or her body. Patients are often asked to complete a series of exercises, at home, between office visits with the physical therapist. Instructions for these exercises are often simple diagrams or pictures, roughly depicting the exercise to be performed. Patients often either forget to perform the exercises in a timely fashion or perform the exercises in a non-optimal way.

An embodiment can maintain a log of these notifications so a user can query and review the event history. The system allows users to author and schedule notifications to be sent when events occur or are missed. In an embodiment, a user has an option to receive notifications personally, at any location and in ways where the user cannot easily avoid or ignore them. A user may also wish to have an event or missed event sent to other persons.

In an embodiment of an exercise compliance system, a sensing device 1 is implemented in a small form factor about the size of a thick quarter or less. The sensing device includes, but is not limited to, any of: a Bluetooth Low Energy (BLE) radio, microcontroller, motion sensor, touch proximity sensors, small coin cell battery, etc., integrated into the device. To allow the device to also function as a notifying device, a small display and LEDs may be added to the device.

A second combination sensing 1/notifying device 14, includes, but is not limited to, any of: a BLE radio, microcontroller, motion and GPS sensors, vibration unit, LEDs, display, battery, etc., may be integrated into a wearable form factor like a fashionable rubberized arm or ankle band.

A gateway device 2, 13 is implemented with an application on a mobile device carried by the user.

The user attaches one or more of the coin size sensing/notifying devices on an exercise apparatus at locations where the sensors can capture the range of motion generated when the equipment is used.

The band shaped combination sensing/notifying device is placed on the user's arm or ankle.

In an embodiment, using a laptop or mobile device as a client device 9, the user accesses the sensing devices and places them into a learn mode. Under the guidance of a personal trainer, coach, physical therapist, trained profession, or self-guided, the user performs a series of exercise tailored to the users desired goals to strengthen, rehabilitate, or burn calories. The sequence of sensory inputs to complete each exercise is saved by the sensors into memory and will be used to detect successful completion of each exercise by the user.

A user, perhaps assisted by a trainer, coach, or physical therapist, sets up policies and rules 10 by entering into the web application information about the exercises to be perform. The type and frequency of each exercise is scheduled. The user enters information about the mobile device used as a gateway, and cell phone numbers and email addresses to send alerts to.

Assume for illustrative purposes, the user, assisted by a physical therapist, sets up rules to rehabilitate a shoulder. The user is to perform three sets of 20 repetitions each, for three different exercises, using a hand weight. The exercises are to be completed once a day, three times week and completed prior to 7:00 pm on the days scheduled. The user must have at least one rest day with no exercise after each day the exercises are completed.

The notification system is then activated and monitoring begins.

On Monday, the user decides to complete a set of exercises and picks up the hand weight with a sensing device 1 attached. The user begins the first set of exercises. The user performs the exercise correctly. The sensing device detects each repetition of the exercise and reports an event to the web application 5 that is logged in the database 7. The notification process 11 notices the activity and based on the rules 10 set by the user, sends out notifications to notifying devices 14 that the exercise is being done correctly.

On Tuesday, the user picks up the hand weight and begins a set of exercises. The sensing device detects activity and notifies the web application. The web application checks the rules, notes that a day of rest is required and sends a warning via notifying devices to the user.

On Wednesday, the user fails to complete the exercises by 7:00 pm. The notification process detects this failure to comply and sends reminders to the user's notification devices.

Upon completing several weeks of physical therapy, the user meets with the physical therapist to review the user's progress. A history of compliance is reviewed online via a client device 9. The therapist assigns a new set of exercises, teaching the user the exercise routine and training the sensors on the equipment the correct sensory input to check for. The therapist also decides to increase the number of repetitions on the previous exercises. The user or therapist adjusts the rules to allow for the changes in the exercise routines for the next few weeks.

The process of meeting with a trainer, coach or physical therapist, adjusting the exercise routine by training the sensors, and updating the policies and rules is repeated for the duration of the exercise program.

8.0 OTHER EMBODIMENTS OF MONITORING SYSTEMS

Many other embodiments are possible in accordance with the present disclosure. Examples are embodiments that include any of: security monitoring systems, asset management monitoring systems, anti-theft monitor systems, elderly care monitoring systems, and baby/children/pet monitoring systems.

An embodiment of a security monitoring system includes, but is not limited to, any of: one more Internet connected sensing devices 2 placed on doors, windows, valuable objects, etc., in rooms. A learn mode may be used to teach the sensing devices what actions to detect. For example, in learn mode the sensor is taught to detect that a window is opened or an object is moved. The user then establishes policies and rules 10 as to when to send a notification to the user. For example, if a window is opened while the user is on vacation or a valuable object like a painting is moved at any time. When the notification process 11 detects that a rule's parameters have been met or violated (e.g., values exceed or fall below set thresholds, etc.), an alert is sent to the notifying devices the user selects 14. In addition to sending alerts, the notifying process can notify a sensing device integrated with a video record apparatus to capture video of the area being monitored. In an embodiment, Internet sensing devices 2 may be placed/attached onto or integrated into non-movable devices. For example, a motion sensing device that detects movement in a room may be attached to a stationary object (e.g., a doorway, a wall, etc.) or a camera may be programmed to look for patterns of movement or recognize a particular face. The stationary sensor could still be programed with patterns by stimulating the sensor with some pattern of events (e.g., motion, breaking an IR beam, the face of the person to recognize, etc.). In an embodiment, Internet notifying devices 13 may be placed/attached onto or integrated into non-movable devices. For example, an audible alarm notify device may be attached to a stationary object (e.g., a doorway, a wall, etc.).

To enable the ability to locate stolen objects, GPS sensors may be integrated into an embodiment of sensing devices that may be placed on valuable objects. If these sensing devices lose contact with the web application, after a period of time they enter a locator mode where they conserve power and occasionally look for an open network where they can communicate their location to the web application.

An embodiment of an asset management monitoring system is similar to the previously discussed security monitoring system. Internet enable sensing devices 2 with GPS sensors may be placed on key assets to be tracked by a company. As assets are moved, events may be sent to the web application reporting the activity and their new location. The web application can query the sensing devices at any time to get their current location. The notification process 11 send notifications, based on policies and rules, to the person(s) responsible to tracking the assets.

An embodiment of an anti-theft monitoring system is similar to the security and asset management monitoring systems described above with the addition of a cellular radio into a combination sensing and notifying device that is placed on the asset. If someone attempts to remove an object being monitored, the device sounds an audible alarm and places a cellular call to notify a security service and/or the owner.

In an embodiment of an elderly care monitoring system, a combination of sensing and notifying device may be used to monitor the care, health and whereabouts of an elderly person. For example, pill container sensing devices 1 monitor medicine use and compliance. An armband sensing & notifying device 14 with a GPS sensor monitors the location of the person. The same armband, with touch sensors, allows the elderly person to generate an event to request assistance in an emergency. Motion sensing devices 1, 3 on objects like a refrigerator door can monitor general activity. Stationary gateways 2 may be placed through the residence of the person being monitored to make sure a wireless network is always available for any Bluetooth enabled monitoring devices used. The caregiver establishes the policies and rules in a way that monitors the personal activities of the elderly person being monitored.

In an embodiment of a baby/children/pet monitoring system, notifying devices 2 may be integrated with cameras to allow video monitoring of babies, small children or pets. Video signals may be analyzed to detect event such as the baby waking up. Small battery powered sensing devices 1 that detect motion can also be attached to the clothing of the baby to monitor movement and alert parents that the child is waking up.

Embodiments include an apparatus comprising a processor and configured to perform any one of the foregoing methods.

Embodiments include a computer readable storage medium, storing software instructions, which when executed by one or more processors cause performance of any one of the foregoing methods.

Note that, although separate embodiments are discussed herein, any combination of embodiments and/or partial embodiments discussed herein may be combined to form further embodiments.

9.0 IMPLEMENTATION MECHANISMS—HARDWARE OVERVIEW

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 7:
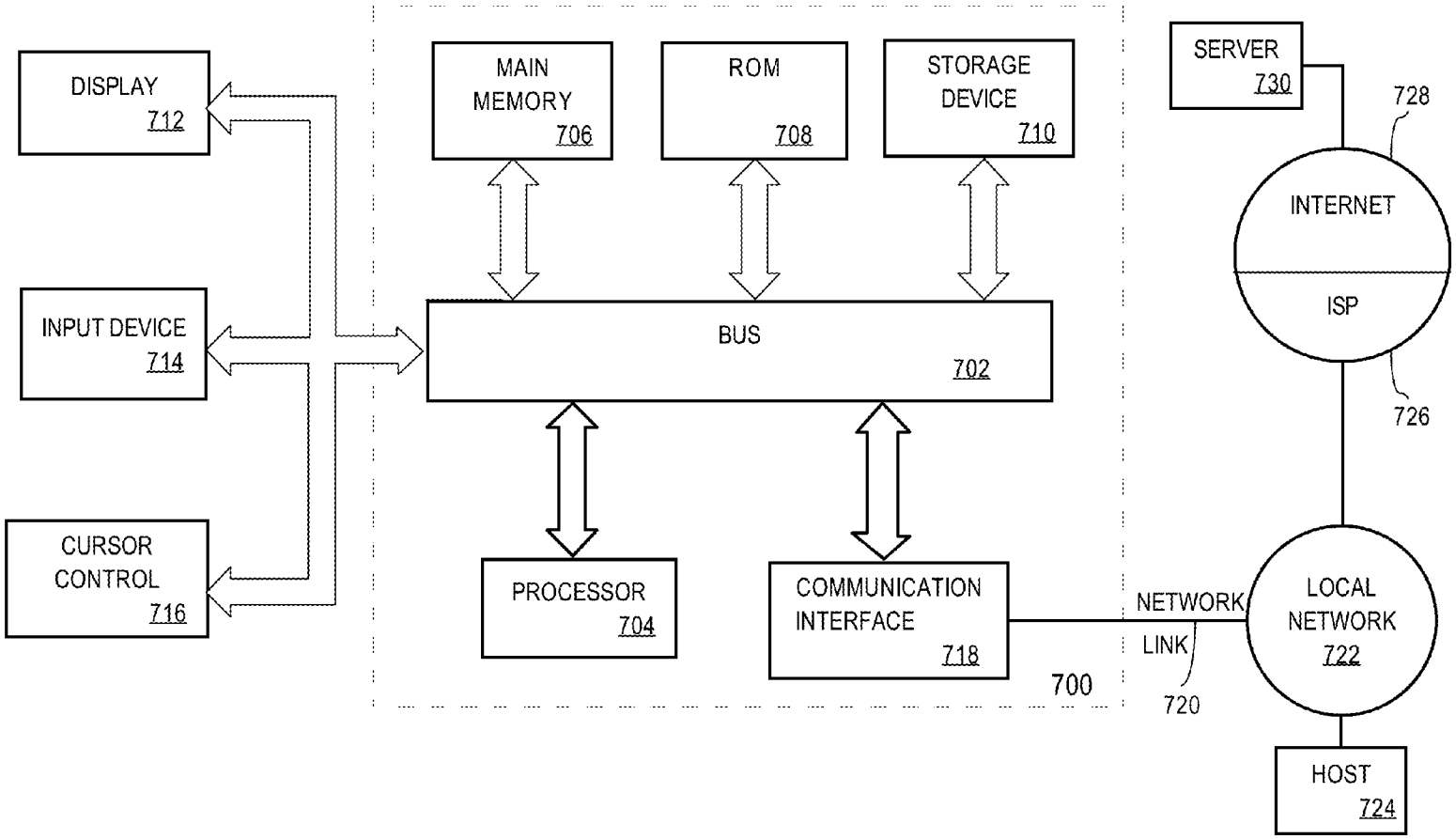
FIG. 7 illustrates an example hardware platform on which a computer or a computing device as described herein may be implemented.

For example, FIG. 7 is a block diagram that illustrates a computer system 700 upon which an example embodiment of the invention may be implemented. Computer system 700 includes a bus 702 or other communication mechanism for communicating information, and a hardware processor 704 coupled with bus 702 for processing information. Hardware processor 704 may be, for example, a general purpose microprocessor.

Computer system 700 also includes a main memory 706, such as a random access memory (RAM) or other dynamic storage device, coupled to bus 702 for storing information and instructions to be executed by processor 704. Main memory 706 also may be used for storing temporary variables or other intermediate information during execution of instructions to be executed by processor 704. Such instructions, when stored in non-transitory storage media accessible to processor 704, render computer system 700 into a special-purpose machine that is customized to perform the operations specified in the instructions.

Computer system 700 further includes a read only memory (ROM) 708 or other static storage device coupled to bus 702 for storing static information and instructions for processor 704. A storage device 710, such as a magnetic disk or optical disk, is provided and coupled to bus 702 for storing information and instructions.

Computer system 700 may be coupled via bus 702 to a display 712, such as a liquid crystal display, for displaying information to a computer user. An input device 714, including alphanumeric and other keys, is coupled to bus 702 for communicating information and command selections to processor 704. Another type of user input device is cursor control 716, such as a mouse, a trackball, or cursor direction keys for communicating direction information and command selections to processor 704 and for controlling cursor movement on display 712. This input device typically has two degrees of freedom in two axes, a first axis (e.g., x) and a second axis (e.g., y), that allows the device to specify positions in a plane.

Computer system 700 may implement the techniques described herein using customized hard-wired logic, one or more ASICs or FPGAs, firmware and/or program logic which in combination with the computer system causes or programs computer system 700 to be a special-purpose machine. According to one embodiment, the techniques herein are performed by computer system 700 in response to processor 704 executing one or more sequences of one or more instructions contained in main memory 706. Such instructions may be read into main memory 706 from another storage medium, such as storage device 710. Execution of the sequences of instructions contained in main memory 706 causes processor 704 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage device 710. Volatile media includes dynamic memory, such as main memory 706. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 702. Transmission media can also take the form of acoustic or light waves, such as those generated during radio-wave and infra-red data communications.

Various forms of media may be involved in carrying one or more sequences of one or more instructions to processor 704 for execution. For example, the instructions may initially be carried on a magnetic disk or solid state drive of a remote computer. The remote computer can load the instructions into its dynamic memory and send the instructions over a telephone line using a modem. A modem local to computer system 700 can receive the data on the telephone line and use an infra-red transmitter to convert the data to an infra-red signal. An infra-red detector can receive the data carried in the infra-red signal and appropriate circuitry can place the data on bus 702. Bus 702 carries the data to main memory 706, from which processor 704 retrieves and executes the instructions. The instructions received by main memory 706 may optionally be stored on storage device 710 either before or after execution by processor 704.

Computer system 700 also includes a communication interface 718 coupled to bus 702. Communication interface 718 provides a two-way data communication coupling to a network link 720 that is connected to a local network 722. For example, communication interface 718 may be an integrated services digital network (ISDN) card, cable modem, satellite modem, or a modem to provide a data communication connection to a corresponding type of telephone line. As another example, communication interface 718 may be a local area network (LAN) card to provide a data communication connection to a compatible LAN. Wireless links may also be implemented. In any such implementation, communication interface 718 sends and receives electrical, electromagnetic or optical signals that carry digital data streams representing various types of information.

Network link 720 typically provides data communication through one or more networks to other data devices. For example, network link 720 may provide a connection through local network 722 to a host computer 724 or to data equipment operated by an Internet Service Provider (ISP) 726. ISP 726 in turn provides data communication services through the world wide packet data communication network now commonly referred to as the "Internet" 728. Local network 722 and Internet 728 both use electrical, electromagnetic or optical signals that carry digital data streams. The signals through the various networks and the signals on network link 720 and through communication interface 718, which carry the digital data to and from computer system 700, are example forms of transmission media.

Computer system 700 can send messages and receive data, including program code, through the network(s), network link 720 and communication interface 718. In the Internet example, a server 730 might transmit a requested code for an application program through Internet 728, ISP 726, local network 722 and communication interface 718.

The received code may be executed by processor 704 as it is received, and/or stored in storage device 710, or other non-volatile storage for later execution.

10.0 EQUIVALENTS, EXTENSIONS, ALTERNATIVES AND MISCELLANEOUS

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A system comprising:

a sensor device attached to a portable storage container, the sensor device including at least: a controller, at least one sensor, a wireless communication device, and a memory device;

the controller detects one or more patterns of movements of the portable storage container via the at least one sensor, the controller matches the detected one or more patterns of movements with patterns stored in the memory device;

the controller reports pattern matches to a reporting device via the wireless communication device;

a strap-on device configured to be worn by a user, the strap-on device configured to receive an alert notification message from the reporting device, the reporting device generating the alert notification message based on the received pattern matches, the strap-on device further configured to communicate the receipt of the alert notification message to the user wearing the strap-on device via any of: one or more visual alerts, one or more audio alerts, or one or more sensory alerts;

the reporting device compares a reported pattern match to a set of rules; and the reporting device sends, to the strap-on device, an alert notification message indicating that the portable storage container should be refilled when parameters of a rule are met indicating that the portable storage container senses that it is in proximity to a bulk storage container and a quantity of doses in the portable storage container is below a threshold.

2. The system of claim 1, wherein the user places the controller into a learning mode to detect a movement pattern using the at least one sensor, and wherein the controller stores the detected movement pattern as one of the patterns stored in the memory device.

3. The system of claim 1, wherein the controller uploads the patterns stored in the memory device to a web application via the wireless communication device, wherein the uploaded patterns are downloaded to another sensor device.

4. The system of claim 1, wherein the moveable object is a medication container cap.

5. The system of claim 1, wherein:

the reporting device compares the reported pattern match to the set of rules; and the reporting device sends an alert to a notification device when parameters of a rule are met or violated by the reported pattern match.

6. The system of claim 1, wherein the reporting device uses reported pattern matches from two or more sensor devices to generate an alert notification, wherein the reporting device sends the alert notification to a notification device.

7. The system of claim 1, wherein the patterns stored in the memory device are predefined patterns uploaded to the sensor device.

8. A method comprising:

detecting, by a sensor device attached to a portable storage container, patterns of movements of the portable storage container;

matching, by the sensor device, the detected patterns of movements with patterns stored in a memory device;

reporting, by the sensor device, pattern matches to a reporting device via a wireless communication link;

receiving, by a strap-on device configured to be worn by a user, an alert notification message from the reporting device, the reporting device generating the alert notification message based on the received pattern matches, the strap-on device communicating an alert to the user wearing the strap-on device via any of: one or more visual alerts, one or more audio alerts, or one or more sensory alerts;

comparing, by the reporting device, a reported pattern match to a set of rules; and sending, by the reporting device, an alert notification message to the strap-on device indicating that the portable storage container should be refilled when parameters of a rule are met indicating that the portable storage container senses that it is in proximity to a bulk storage container and a quantity of doses in the portable storage container is below a threshold.

9. The method of claim 8, further comprising:

placing, by the user, the sensor device into a learning mode to detect a movement pattern, and storing the detected movement pattern as one of the patterns stored in the memory device.

10. The method of claim 8, further comprising:

uploading the patterns stored in the memory device to a web application via the wireless communication link, wherein the uploaded stored patterns are downloaded to another sensor device.

11. The method of claim 8, further comprising:

comparing, by the reporting device, the reported pattern match to the set of rules; and sending, by the reporting device, an alert to a notification device when parameters of a rule are met or violated by the reported pattern match.

12. The method of claim 8, further comprising:

generating, by the reporting device, an alert notification using reported pattern matches from two or more sensor devices; and sending, by the reporting device, the alert notification to a notification device.

13. The method of claim 8, further comprising:

uploading predefined patterns to the sensor device, wherein the predefined patterns correspond to at least a subset of the patterns stored in the memory device.

14. A system comprising:

a sensor device associated with a portable storage container;

a web application;

a strap-on device;

the sensor device configured to detect patterns of movements of the portable storage container and configured to match the detected patterns of movements with patterns stored in a memory device of the sensor device;

the sensor device configured to report pattern matches to the web application across the Internet;

the web application configured to compare the reported pattern matches to a set of rules;

the web application configured to send an alert to the strap-on device indicating that the portable storage container should be refilled when parameters of a rule are met indicating that the portable storage container senses that it is in proximity to a bulk storage container and a quantity of doses in the portable storage container is below a threshold; and the strap-on device communicating the alert to a user wearing the strap-on device via any of: one or more visual alerts, one or more audio alerts, or one or more sensory alerts.

15. The system of claim 14, wherein the web application is accessible by a client device via the Internet allowing the client device to configure the set of rules stored by the web application.

16. The system of claim 15, wherein at least a subset of the patterns stored in the memory device are uploaded by the web application to the sensor device.

17. The system of claim 14, wherein the web application is accessible by a client device via the Internet allowing the client device to configure sensor devices in communication with the web application.

18. The system of claim 14, wherein the web application compares the reported pattern matches to the set of rules and sends an alert to a notification device when parameters of a rule are met or violated.

19. A system comprising:

a sensor device attached to a portable storage container, the sensor device including at least: a controller, at least one sensor, a wireless communication device, and a memory device;

the controller detects one or more patterns of movements of the portable storage container via the at least one sensor, the controller matches the detected one or more patterns of movements with patterns stored in the memory device;

the controller reports pattern matches to a reporting device via the wireless communication device;

a strap-on device configured to be worn by a user, the strap-on device configured to receive an alert notification message from the reporting device, the reporting device generating the alert notification message based on the received pattern matches, the strap-on device further configured to communicate the receipt of the alert notification message to the user wearing the strap-on device via any of: one or more visual alerts, one or more audio alerts, or one or more sensory alerts;

the reporting device compares the reported pattern matches to a set of rules; and the reporting device sends, to the strap on device, an alert notification message that the portable storage container should be refilled when parameters of a rule are met indicating that the portable storage container senses that it is in proximity to a bulk storage container and a quantity of doses in the portable storage container is below a threshold, and sends an alert notification message that the user is attempting to take a dosage of medication earlier than scheduled when parameters of a second rule are violated indicating that the user is attempting to take a dosage of medication earlier than scheduled, thereby preventing an overdose condition.

20. A method comprising:

detecting, by a sensor device attached to a portable storage container, patterns of movements of the portable storage container;

matching, by the sensor device, the detected patterns of movements with patterns stored in a memory device;

reporting, by the sensor device, pattern matches to a reporting device via a wireless communication link;

receiving, by a strap-on device configured to be worn by a user, an alert notification message from the reporting device, the reporting device generating the alert notification message based on the received pattern matches, the strap-on device communicating an alert to the user wearing the strap-on device via any of: one or more visual alerts, one or more audio alerts, or one or more sensory alerts;

comparing, by the reporting device the reported pattern matches to a set of rules; and sending, by the reporting device, an alert notification message that the portable storage container should be refilled to the strap-on device when parameters of a rule are met indicating that the portable storage container senses that it is in proximity to a bulk storage container and a quantity of doses in the portable storage container is below a threshold, and sends an alert notification message that the user is attempting to take a dosage of medication earlier than scheduled when parameters of a second rule are violated indicating that the user is attempting to take a dosage of medication earlier than scheduled, thereby preventing an overdose condition.

* * * * *